US005832685A

United States Patent [19]

Hermanson

[11] Patent Number: 5,832,685

[45] Date of Patent: Nov. 10, 1998

[54] SELF-SUPPORTING INTERIOR SURFACE PANEL

[76] Inventor: Lars S. Hermanson, 18 Delhi Crescent, Markham, Ontario, Canada, L3R 4J6

[21] Appl. No.: 510,961

[22] Filed: Aug. 3, 1995

[51] Int. Cl.[6] ..... E04B 1/74

[52] U.S. Cl. ..... 52/506.07; 52/506.06; 52/630; 52/144; 428/221

[58] Field of Search ..... 52/506.07, 506.06, 52/144, 145, 783.1, 791.1, 797.1, 800.12, 630, 393, DIG. 13; 428/224, 246, 463, 221

[56] References Cited

U.S. PATENT DOCUMENTS

| | | | |
|---|---|---|---|
| 3,308,506 | 3/1967 | Olson | 52/144 X |
| 3,460,299 | 8/1969 | Wilson | 52/144 |
| 3,504,462 | 4/1970 | Akerson | 52/791.1 X |
| 3,511,010 | 5/1970 | Wood | 52/393 |
| 3,765,141 | 10/1973 | Shayman | 52/506.07 |
| 3,844,080 | 10/1974 | Brock et al. . | |
| 4,145,468 | 3/1979 | Mizoguchi et al. | 428/246 X |
| 4,157,415 | 6/1979 | Lindenberg . | |
| 4,219,603 | 8/1980 | Thun | 428/246 |
| 4,347,912 | 9/1982 | Flocke et al. . | |
| 4,420,526 | 12/1983 | Schilling et al. . | |
| 4,437,542 | 3/1984 | Yeager et al. . | |
| 4,695,501 | 9/1987 | Robinson . | |
| 5,115,616 | 5/1992 | Nixon | 52/144 |
| 5,134,822 | 8/1992 | Edlin | 52/DIG. 13 X |
| 5,251,414 | 10/1993 | Duke | 52/630 X |
| 5,259,163 | 11/1993 | Pacione . | |
| 5,405,661 | 4/1995 | Kim et al. | 428/224 X |
| 5,436,064 | 7/1995 | Schnegg et al. . | |
| 5,462,786 | 10/1995 | Van Ert . | |
| 5,493,081 | 2/1996 | Manigold . | |
| 5,507,125 | 4/1996 | McClure | 52/586.07 |
| 5,523,146 | 6/1996 | Bodford et al. | 428/244 X |
| 5,547,743 | 8/1996 | Rumiesz | 428/224 |

FOREIGN PATENT DOCUMENTS

| | | |
|---|---|---|
| 583504 | 2/1984 | European Pat. Off. . |
| 2510607 | 9/1975 | Germany . |
| 3534690 | 6/1987 | Germany . |
| 2121354 | 12/1983 | United Kingdom . |
| 2133431 | 7/1984 | United Kingdom . |
| 9205327 | 4/1992 | WIPO . |

*Primary Examiner*—Robert Canfield
*Attorney, Agent, or Firm*—Panitch Schwarze Jacobs & Nadel, P.C.

[57] ABSTRACT

The present invention relates to a self-supporting, sound absorbing interior surface panel comprising a non-woven fabric. The non-woven fabric may be laminated to a facing fabric using a heat activated thermoplastic adhesive, or the panel may be provided with a micro-porous top-coat finish. The panel of the invention may be provided with a vibration absorbent perimeter edge which may be shaped in an accordion-like fashion integrally with the rest of the panel, or manufactured separately of a flexible but resilient material and attached to the panel. The invention further relates to a suspended ceiling module comprising a support structure, such as a tee bar grid, and a panel of the invention which could be supported within the module in either tegular or coffered orientation. The invention also relates to a method of manufacturing the self-supporting interior surface panel.

17 Claims, 3 Drawing Sheets

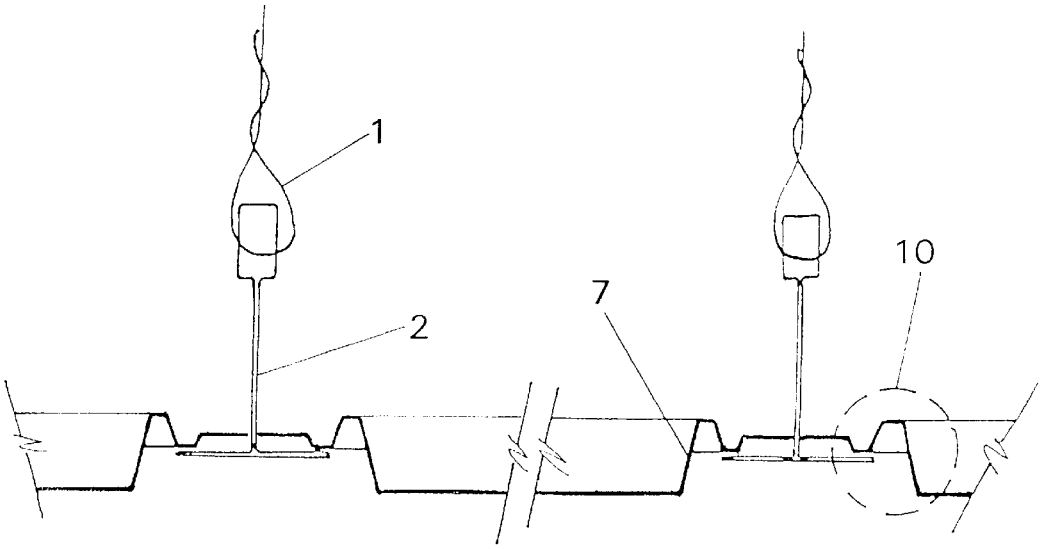
Fig. 5
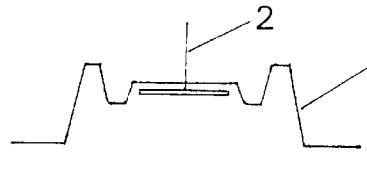
Fig. 7:1
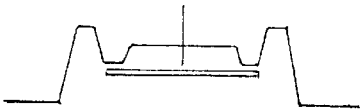
Fig. 7:2
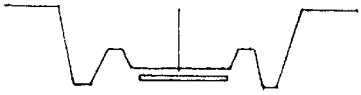
Fig. 7:3
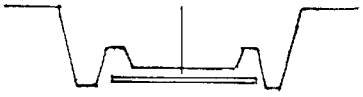
Fig. 7:4
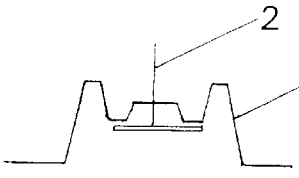
Fig. 7:5
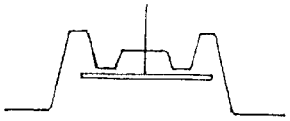
Fig. 7:6
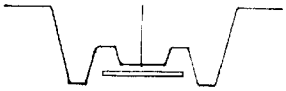
Fig. 7:7
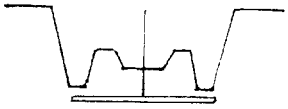
Fig. 7:8

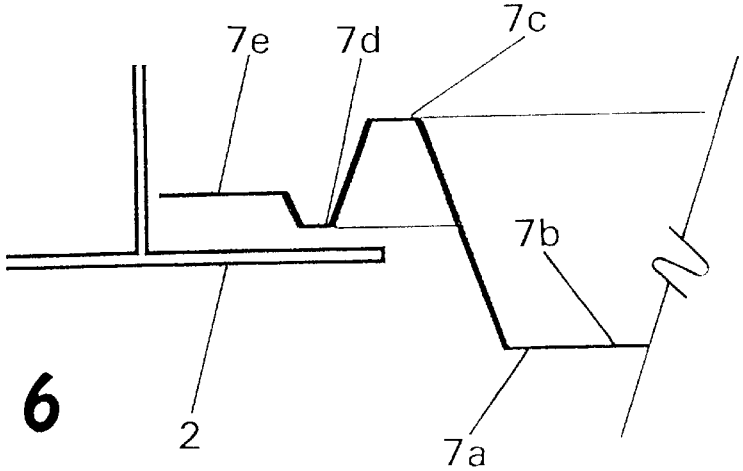
Fig. 6
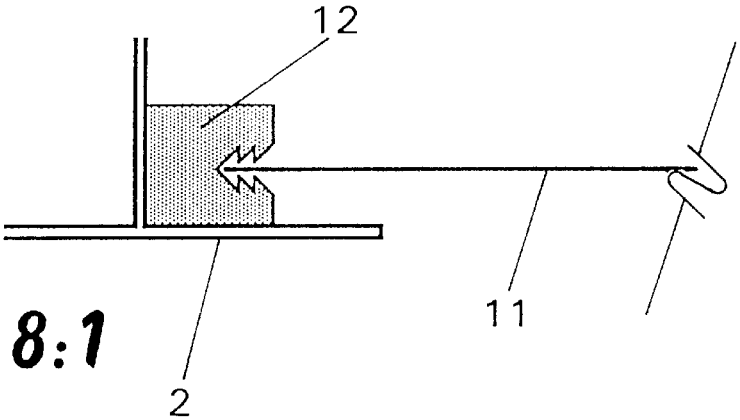
Fig. 8:1
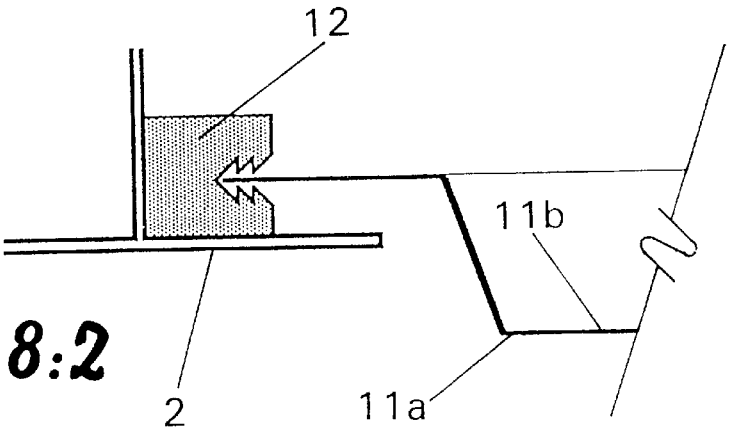
Fig. 8:2

SELF-SUPPORTING INTERIOR SURFACE PANEL

FIELD OF THE INVENTION

The present invention relates to interior building materials having sound absorbing characteristics. More specifically, this invention relates to a lightweight, self-supporting, sound absorbing interior surface panel, as well as to the method of the production thereof.

BACKGROUND OF THE INVENTION

Ceiling panels for use as suspended ceilings are well known in the art. Providing sound absorbtion, decoration, light reflection, visual plenum masking and other functions, such panels are provided in various materials and sizes and can be suspended from a number of suitable support systems. The most commonly used support system is made of roll-formed aluminum or steel "tee" section elements, known in the art as tee bars, which are spaced apart so as to provide, for example, either metric (600 mm) or imperial size (24") openings, known in the art as modules.

For additional acoustic insulation, such panels can also be applied to other surfaces, particularly walls, to provide sound absorption in areas such as shopping centres, offices, transportation terminals, recording studios, concert halls, sport centres, etc.

Panels of the type described above have been fabricated from a variety of materials, for example wood and cork. More recently, they are often made from mineral fibre, fibreglass, metals, or composites or laminates thereof. All such panels provide acoustic properties in addition to having a decorative effect.

Mineral fibre board panels are the most common type of interior surface panels. They are the least expensive panels of all known types, but have certain shortcomings. Most notably, they are fragile. They often absorb moisture which results in discoloured or sagging panels. In order to achieve necessary acoustical properties and structural integrity, they are often at least ½" (12.5 mm) thick, depending on the application. Custom trimming of panels is often messy and may increase the release of mineral fibres into the air. Fibres released into the air can adversely affect the quality of air in a particular space or an entire building.

High density fibreglass panels share some of the drawbacks of mineral fibre panels, particularly the possibility of the release of loose fibres into the air. Such panels are often expensive compared to other known materials. Due to the generally poor appearance of plain fibreglass, the panels are usually coated, or provided with a facing fabric which is attached to the base material along the perimeter edge. This is the reason fibreglass panels are not suitable for site trimming and are normally made to order from measuring actual (finished) site dimensions.

Metal panels are traditionally less expensive to manufacture and ship than high density fibreglass panels. However, due to the cost of metal, forming, perforation, painting and a sound absorbing element which is introduced into the panel, they are considerably more expensive than mineral fibre board panels. The panels are often bulky and require special care during packing, in order to avoid damage during transportation.

Therefore, there is a need for a durable and yet thin, lightweight, structurally stable interior surface panel which would possess the necessary sound absorbing characteristics, in addition to providing easy handling, installation and removal. Such a panel would also allow for easy on-site trimming without releasing any harmful fibres. The panel of the present invention, in addition to meeting the above requirements, also possesses superior thermal stability and is not affected by conditions of high humidity.

SUMMARY OF THE INVENTION

The present invention relates to a self-supporting, sound absorbing interior surface panel comprised of a non-woven fabric. For the purposes of this application, the term "interior surface panel" is intended to encompass ceiling and wall panels. The term "self-supporting" is intended to denote that the panel, comprised of a non-woven fabric, is capable of supporting its own weight and retaining the shape without utilizing any additional reinforcing devices, materials or techniques. In addition to superior sound absorbing characteristics over a broad range of frequencies, the interior surface panel of the invention is thin, lightweight, 100% recyclable, possesses good thermal stability and can be used in areas of high humidity.

In one aspect, the panel of the present invention is comprised of a non-woven fabric.

In another aspect, the non-woven fabric of the panel is laminated to a facing fabric using a thermoplastic adhesive. In a further aspect, the facing fabric may be of a looped or unbroken loop type, so as to provide for a semi-permanent structural connection with a tee bar suspension grid provided with a hook (male) element of a hook-and-loop fastener.

In yet another aspect, the non-woven fabric of the panel is provided with a micro-porous top-coat finish.

In still another aspect, the panel may be provided with a vibration absorbent perimeter edge. According to one embodiment of the invention, the vibration absorbent perimeter edge has an accordion-like shape and is moulded or otherwise formed integrally with the rest of the panel. According to another embodiment, the perimeter edge is made of a flexible but resilient material which is attached to the panel.

In a further aspect, the invention provides a method for manufacturing a self-supporting, sound absorbing interior surface panel of the present invention.

BRIEF DESCRIPTION OF THE DRAWINGS

For a better understanding of the present invention and to show more clearly how it may be carried into effect, reference will now be made by way of example to the accompanying drawings, which illustrate the panel according to preferred embodiments of the invention. In the drawings:

FIG. 5 is an enlarged cross-sectional side view of the panel of FIG. 4, FIG. 6 shows the detail of a vibration absorbent, accordion-like perimeter edge of the panel of FIG. 4, designated as 10 on FIG. 5, FIGS. 7:1 to 7:8 are cross-sectional side views of the panel of FIG. 4, installed in either tegular or coffered orientation into imperial or metric support modules incorporating tee bars of various sizes, and FIGS. 8:1 and 8:2 are cross-sectional side views similar to the one presented in FIG. 6, illustrating the panel according to another preferred embodiment of the present invention.

DETAILED DESCRIPTION OF THE PREFERRED EMBODIMENTS

Figure 1:
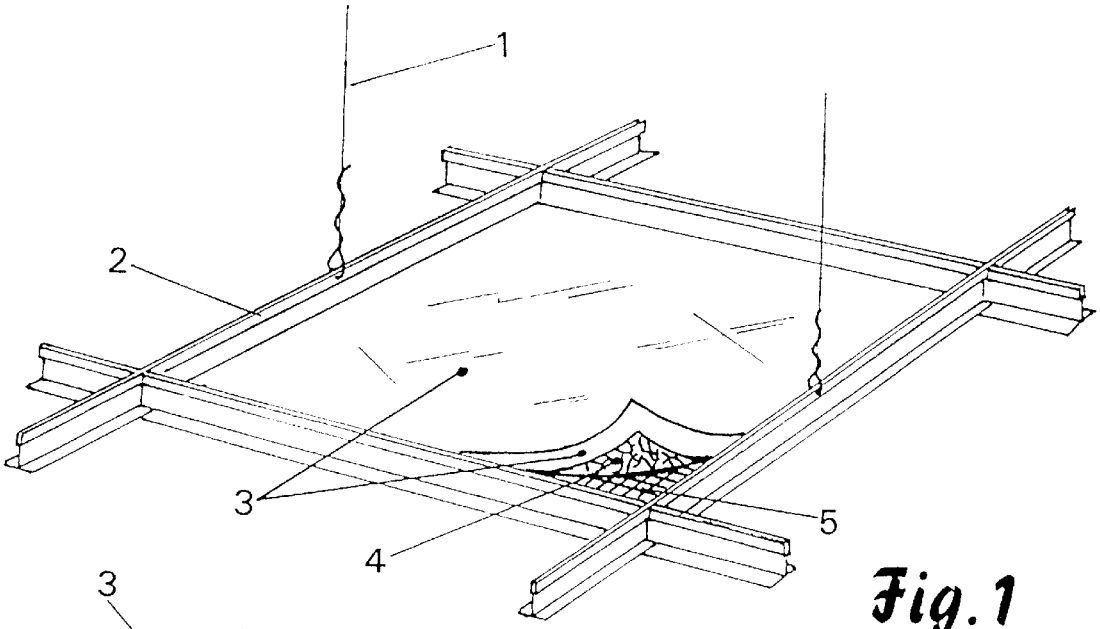
FIG. 1 is a prospective, partially lifted view of the panel according to one preferred embodiment of the invention, suspended within a module of corresponding supporting ceiling structure.

The interior surface panel according to the preferred embodiment of the present invention is comprised of a non-woven fibre fabric weighing approximately 10 to 15 oz/yd$^2$ (350 to 550 g/m$^2$). The thickness of the fabric is approximately 0.04 to 0.06" (1 to 1.5 mm). The fabric can be a spun-bond fabric of synthetic polymer fibre such as polyester, polypropylene or polyamide. This type of fabric is usually formed by extruding essentially endless filaments of polymer and bonding such filaments using a thermal, mechanical or chemical process, or a combination thereof. Fibres to make such fabrics typically have a denier of 4 to 12. Other natural and synthetic fibres, such as cotton, wool, acrylic, cellulose, polyolefin, polyvinyl chloride, or blends thereof, may also be used. Such other fibres are typically short in length (under 2" or 50 mm) with a denier of 1.5 to 10, and are bonded together by a thermal, mechanical or chemical process, or a combination thereof. It is important to have the fibres tightly adhered within the material to achieve a proper sound impedance and to prevent the vibration of individual fibres in response to sound waves.

In a preferred embodiment of the invention, the fabric is manufactured of essentially endless polyester fibres. The fibres are bonded together autogenously, through the application of heat. Additionally, the fibres could be bonded together using a chemical binder or resin, for example in a manner described in U.S. Pat. No. 4,420,526, the disclosure of which is incorporated herewith by reference.

According to another preferred embodiment of the present invention, the non-woven fabric of the panel is laminated to a facing fabric using a thermoplastic adhesive.

The thermoplastic adhesive is usually of a low melt polyester or polyethylene type, with typical activation temperatures in the range of from 230° to 275° Fahrenheit (110° to 135° Celsius). As the adhesive is activated, it flows and fills in the segments of the pores in the fabric, lowering its air permeability. The adhesive also helps to bond the fibres in place, which assists in preventing the vibration of individual fibres in response to sound waves.

In a preferred embodiment of the present invention the adhesive is applied between the fabrics in a form of a web. The weight and density of the adhesive web are carefully selected depending on the characteristics of facing fabric being used, to provide the finished panel with a desired sound impedance. Typical weights of the adhesive web are from 1 to 2 oz/yd$^2$ (35 to 70 g/m$^2$).

The adhesive used can be pre-coated on either the non-woven fabric or the facing fabric by printing, or by dispersing the adhesive in a powdered form. The adhesive may be printed typically using screen print cylinders or gravure cylinders. In a powdered form, the adhesive is dispersed on the material surface and sintered in place with heat.

The facing fabric is typically of a woven type and made of polyester or polyamide. The facing fabric has two functions. It provides for improved aesthetics, which is often an important requirement for ceiling and wall systems, and further lowers the air permeability of the panel.

Additionally, a facing fabric of looped or unbroken loop polyester or polyamide (female), in combination with a typical hook (male) element of a hook-and-loop fastener (e.g. Velcro®) attached to the supporting tee bar, can provide for a semi-permanent structural connection. In ceiling systems, such a connection helps to prevent uplift of the panel away from the horizontal portion of the tee bar due to a sudden change in air pressure. In wall systems, such a semi-permanent structural connection may permit the use of a simple tee bar supporting structure similar to the one used for ceilings.

According to a further preferred embodiment, the panels of the present invention can be provided with a micro-porous top-coat finish applied to the non-woven fabric. In addition to the decorative effect, the coat provides for a lower air permeability and prevents vibration of the individual fibres in response to sound waves, similarly to the effect of the adhesive web when panel is laminated to a facing fabric.

In a preferred embodiment of the invention, the ceiling and wall panel is provided with a vibration absorbent perimeter edge. In addition to acting as a sound vibration absorber, the perimeter edge enables the panel to be relieved from any structural tension, allows for smaller size variations of the grid module and, in ceiling applications, acts to bias the perimeter of the panel against the vertical member of a tee bar, so as to prevent the panel from being lifted up from the grid due to any sudden change of air pressure (uplift).

According to one preferred embodiment, the vibration absorbent perimeter edge has an accordion-like shape and is moulded or otherwise formed integrally with the rest of the panel. Such an accordion-like perimeter edge allows for the panels manufactured using identical moulds to be trimmed for use both in metric (600 mm) and imperial (24") grid modules and to provide for both tegular and coffered orientation.

According to another preferred embodiment of the invention, the vibration absorbent perimeter edge is made of a flexible but resilient material which is attached to the panel. It will be obvious to a person skilled in the art that a number of materials can be used. For example, the perimeter edge according to this embodiment of the invention can be manufactured of rubber, neoprene, polyurethane, silicone, etc.

Figure 2:
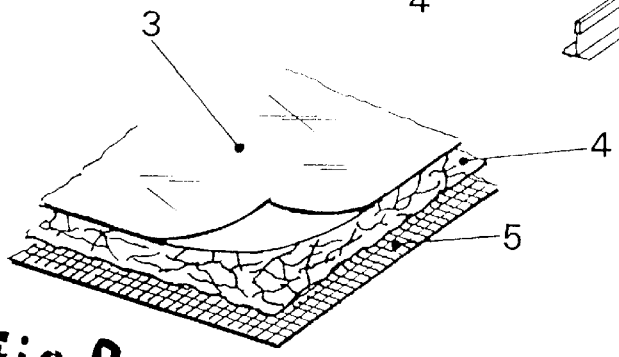
FIG. 2 is a prospective, exploded and partially lifted view of the panel of FIG. 1.

In one preferred embodiment illustrated in FIG. 1, the panel 7 is comprised of a non-woven fabric 3, adhesive web 4 and facing fabric 5. Panel 7 is suspended in a typical tee bar grid 2 which is hung from the support plane by means of a hanger wire 1. The depth of a substantially unobstructed air space behind the panel is at least 1" (25 mm). The layered structure of the panel according to this embodiment of the present invention is illustrated in more detail in FIG. 2.

Figure 3:
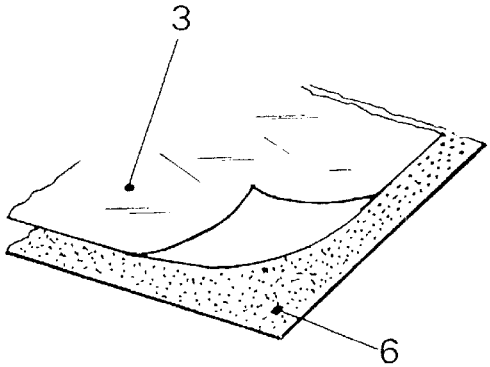
FIG. 3 is a prospective, exploded and partially lifted view of the panel according to another preferred embodiment of the present invention.

According to another preferred embodiment of the present invention (not shown), the panel is comprised of a non-woven fabric without the facing fabric. According to still another preferred embodiment, illustrated in FIG. 3, the panel 7 is provided with a micro-porous top-coat finish 6 applied directly to the non-woven fabric 3.

Figure 4:
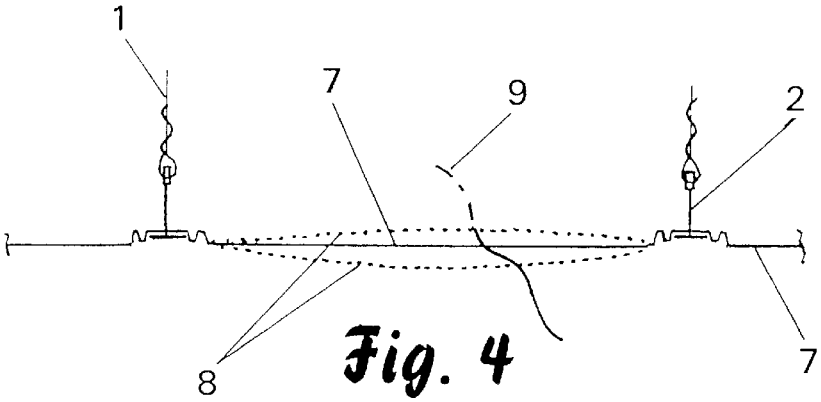
FIG. 4 is a cross-sectional side view of the panel according to one preferred embodiment of the present invention, showing its vibration in response to sound waves.

The vibration of the panel 7 in response to sound waves, represented (exaggeratedly) by end-positions 8 in FIG. 4, is highly absorbed both by the high internal damping of the fabric itself and by a vibration absorbent, accordion-like perimeter edge of the panel. The perimeter edge according to this embodiment of the invention, designated as 10 in FIG. 5 and enlarged in FIG. 6, also provides for an increased structural stability of the panel and allows it to fit support grid modules of various sizes. Depending on the size of the module, the width of tee bars, and the orientation of the panels, the panel face 7*c*, 7*d* or 7*e*, respectively, will rest on a horizontal member of a tee bar as shown in FIG. 7.

FIGS. 7:1 to 7:8 illustrate the versatility of the panel according to this embodiment of the present invention. The panel can fit both metric (600 mm) and imperial (24") grid modules employing tee bars with either narrow (14 mm or 9/16") or wide (24 mm or 15/16") horizontal members. The panel can be supported within the grid in either tegular or coffered orientation. If the panel is to be used in a tegular orientation, a facing fabric or a top-coat finish will be applied to the side 7*a* of the panel (FIG. 6). If, on the other hand, the panel is to be used in a coffered orientation, a facing fabric or a top-coat finish will be applied to the side 7*b*. FIGS. 7:1 to 7:8 show the following arrangements:

| Imperial 24" Module: | Metric 600 mm Module: |
|---|---|
| 7:1 Tegular lay-in; 9/16" tee bar | 7:5 Tegular lay-in; 14 mm tee bar |
| 7:2 Tegular lay-in; 15/16" tee bar | 7:6 Tegular lay-in; 24 mm tee bar |
| 7:3 Coffered lay-in; 9/16" tee bar | 7:7 Coffered lay-in; 14 mm tee bar |
| 7:4 Coffered lay-in; 15/16" tee bar | 7:8 Coffered lay-in; 24 mm tee bar |

According to another preferred embodiment of the present invention, illustrated in FIGS. 8:1 and 8:2, the vibration absorbent perimeter edge 12 is manufactured separately, from a flexible but resilient material as described above. The central part 11 of the panel is comprised of a moulded or otherwise formed non-woven fabric which is optionally provided with a micro-porous top-coat finish, or of a non-woven fabric/facing fabric laminate. The central part 11 may be essentially flat (FIG. 8:1) or may have a profiled cross-section (FIG. 8:2). The panel of FIG. 8:2 may be supported within a tee bar grid 2 in either tegular or coffered orientation, in a manner similar to the one described with respect to FIG. 7. If a non-woven fabric/facing fabric laminate is used, the facing fabric will be applied to the side 11*a* or the side 11*b* for tegular or coffered orientation, respectively.

The present invention also relates to a method of manufacturing the sound absorbing ceiling and wail panel.

In one embodiment, the panel is manufactured from a single non-woven fabric layer. In another embodiment, the panel is manufactured from a composite fabric.

The composite fabric is formed by laminating a non-woven fabric and a facing fabric. This is accomplished by applying a thermoplastic adhesive to either a non-woven fabric or a facing fabric, activating the adhesive with heat and applying pressure to both fabrics, for example using heated steel rollers or directing hot air through the fabrics in an oven and nipping them together as they exit the oven. According to the invention, the fabrics can also be laminated together during the moulding process itself. Typical activation temperatures for the thermoplastic adhesive are 230° to 275° Fahrenheit (110° to 135° Celsius).

In the method according to the preferred embodiment of the invention, a non-woven fabric or a laminated composite is preheated prior to moulding/forming, to increase the plasticity. The temperature range for the preheating step is, for example, 260° to 285° Fahrenheit (125° to 140° Celsius). If the lamination is to take place during the moulding process, a thermoplastic adhesive is applied to either a non-woven fabric or a facing fabric and the facing fabric is positioned over the preheated non-woven material. The panel is then moulded or otherwise formed to the desired shape under heat and pressure. Typical moulding temperature is approximately 230° to 260° Fahrenheit (110° to 125° Celsius), while the pressure is at least 15 psi (100 kPa).

The finished panel according to the preferred embodiment of the invention has an acoustic impedance of approximately 30 to 100 Rayl and a bending stiffness of between 1 and 500 $MN/m^2$ (Mega Newton per square meter). The low frequency resonant behaviour of the panel depends on its stiffness, mass, thickness and support conditions. As the panel is lightweight, stiff and has a high internal damping, low frequency vibrations corresponding with the resonant frequencies of the panel will be highly damped. This extends the lower useful absorbing range of the panel to practically 0 Hz.

The sound absorbing ceiling and wall panel of the present invention is very light compared to known structurally stable ceiling panels with acoustical damping properties. The handling of the panels during the shipping, installation and removal is very easy and cost-effective. As the panel of the invention is very thin, it also offers a simple solution for an upgrade or retrofit of an existing ceiling. As the new panel requires only a minimum added height, old ceiling panels (for example mineral fibre ceiling panels) may remain in place within the support grid, above the panels of the present invention. It should be noted, however, that old panels can remain in place only if they possess sound absorbing properties. Non-absorbent panels will have to be removed, but the existing tee bar grid can still be used.

The microscopic pores in the non-woven fabric, the facing fabric or the micro-porous topcoat finish provide for an optically superior non-glare surface with a high degree of light reflectivity often desired in environments where task lighting is critical (assembly lines, computer or other office work, etc.). The high degree of light reflectivity also reduces the number and required strength of light sources, thereby contributing to energy conservation.

While in this specification the invention has been described in detail through examples of some of the preferred embodiments thereof, many variations and modifications could be made without departing from the scope and spirit of the present invention. For example, it is possible to emboss the panel during the moulding process, in order to obtain a patterned appearance often sought by architects and interior designers. The resulting panel may have the additional advantage that the embossed areas provide structural reinforcement and additional rigidity. Also, the particular shapes of the vibration absorbent perimeter edge, illustrated in detail in FIGS. 6 and 8, are given as examples only. Furthermore, it is possible to provide the panel of the present invention with a water-repellant surface treatment, for areas where frequent cleaning of panel is desirable.

What is claimed is:

1. A self-supporting interior surface panel comprising a non-woven fibre fabric as a supporting material, the panel being provided with a vibration absorbent perimeter edge.

2. A self-supporting interior surface panel according to claim 1, wherein the vibration absorbent perimeter edge is shaped of the non-woven fibre fabric integrally with the rest of the panel.

3. A self-supporting interior surface panel according to claim 1, wherein the vibration absorbent perimeter edge comprises a flexible but resilient material which is attached to the panel.

4. A self-supporting interior surface panel comprising a non-woven fibre fabric laminated to a facing fabric, the panel being provided with an integrally shaped vibration absorbent perimeter edge, and having an acoustic impedance of approximately 30 to 100 Rayl and a bending stiffness of between 1 and 500 $MN/m^2$.

5. A self-supporting interior surface panel comprising a non-woven fibre fabric, the panel being provided with an integrally shaped vibration absorbent perimeter edge and a micro-porous top-coat finish, and having an acoustic impedance of approximately 30 to 100 Rayl and a bending stiffness of between 1 and 500 $MN/m^2$.

6. A suspended ceiling module comprising a self-supporting interior surface panel comprising a non-woven fibre fabric laminated to a facing fabric, the panel being provided with an integrally shaped vibration absorbent perimeter edge, and having an acoustic impedance of approximately 30 to 100 Rayl and a bending stiffness of between 1 and 500 $MN/m^2$, said panel being suspended in a tee bar grid.

7. A suspended ceiling module comprising a self-supporting interior surface panel comprising a non-woven fibre fabric, the panel being provided with an integrally shaped vibration absorbent perimeter edge, and a micro-porous top-coat finish, and having an acoustic impedance of approximately 30 to 100 Rayl and a bending stiffness of between 1 and 500 $MN/m^2$, said panel being suspended in a tee bar grid.

8. A suspended ceiling module comprising a self-supporting interior surface panel comprising a non-woven fibre fabric as a supporting material, said panel being suspended in a suspension structure.

9. A suspended ceiling module according to claim 8, wherein the suspension structure comprises a tee bar grid.

10. A suspended ceiling module according to claim 8, further comprising a facing fabric laminated to the non-woven fibre fabric, said facing fabric being a polyester or polyamide fabric.

11. A suspended ceiling module according to claim 8, wherein the non-woven fibre fabric is further provided with a micro-porous top-coat finish.

12. A suspended ceiling module according to claim 8, wherein self-supporting interior surface panel further comprises a vibration absorbent perimeter edge.

13. A suspended ceiling module according to claim 12, wherein the vibration absorbent perimeter edge is shaped of the non-woven fibre fabric integrally with the rest of the panel.

14. A suspended ceiling module according to claim 12, wherein the vibration absorbent perimeter edge comprises a flexible but resilient material which is attached to the panel.

15. A suspended ceiling module according to claim 8, wherein the depth of a substantially unobstructed air space behind the panel is at least 25 mm.

16. A suspended ceiling module according to claim 8, wherein the panel is supported in a tegular orientation.

17. A suspended ceiling module according to claim 8, wherein the panel is supported in a coffered orientation.

* * * * *